US005409745A

United States Patent [19]

McGuire

[11] Patent Number: 5,409,745

[45] Date of Patent: Apr. 25, 1995

[54] ARTIFICIAL CHRISTMAS TREE

[76] Inventor: Edward J. McGuire, 14938 Zahm Rd., Rockton, Ill. 61072

[21] Appl. No.: 167,172

[22] Filed: Dec. 16, 1993

[51] Int. Cl.[6] ..... A47G 33/06

[52] U.S. Cl. ..... 428/18; 428/19; 428/20

[58] Field of Search ..... 428/18, 19, 20; 24/509, 24/510, 567

[56] References Cited

U.S. PATENT DOCUMENTS

| | | | |
|---|---|---|---|
| 2,864,192 | 12/1958 | Shoalts | 428/18 X |
| 3,581,419 | 6/1971 | McCracken | 428/18 X |
| 3,857,748 | 12/1974 | Thomann | 428/20 X |
| 4,109,036 | 8/1978 | Lloyd et al. | 428/20 X |
| 4,959,892 | 10/1990 | Wang | 24/10 |
| 5,115,921 | 5/1992 | Lavelle | 428/19 X |

FOREIGN PATENT DOCUMENTS

| | | | |
|---|---|---|---|
| 318 | of 1855 | United Kingdom | 428/99 |
| 960760 | 6/1964 | United Kingdom | 428/19 |

*Primary Examiner*—Henry F. Epstein

*Attorney, Agent, or Firm*—David L. Baker; Rhodes & Ascolillo

[57] ABSTRACT

An artificial Christmas tree has a trunk. The trunk has a branch retaining rod and a plurality of branch retaining ports in the branch retaining rod. There is a branch retaining rod horizontal support member releasably attached to one end of the branch retaining rod. A branch retaining rod vertical support member is attached to another end of the branch retaining rod. There are a plurality of flexible branches. Each flexible branch has a flexible member and a plurality of artificial needles retained in the flexible member. The flexible member has an insertion end for insertion into a branch retaining port. There is an ornament retaining member releasably attached to the flexible branches. The ornament retaining member has a hinged retaining clip and a spring. The spring is attached to and biases the hinged retaining clip from an open position to an closed position. The branch retaining rod also has at least two interconnectable sections releasably and threadingly connected together or alternatively foldingly connected.

3 Claims, 4 Drawing Sheets

ARTIFICIAL CHRISTMAS TREE

BACKGROUND OF THE INVENTION

1. Field of the Invention

This invention relates to an artificial Christmas tree that can be placed in areas where space is a premium. The tree may be placed fiat against a vertical surface or into a corner.

2. Description of the Related Art

Many artificial trees have been placed on the market. But few solve the problem of inadequate space and the problems associated with placing an unevenly weighted tree and keeping decorations in place.

U.S. Pat. No. 2,864,192 to R. L. Shoalts on Dec. 16, 1958 for a Simulated Christmas Tree describes a tree that has a large rectangular backing plate having a series of arcuate wire members connected by radially extending wire members and upwardly extending wire members all in a configuration to simulate a Christmas tree. There is a wire tree trunk and decorations on the tree.

U.S. Pat. No. 3,581,419 to R. S. McCracken on Jun. 1, 1971 for A Decorative Door-Hung Tree Structure for Greeting Cards shows a decorative door-hung tree structure made out of foam plastic. There is a set of skirt sections having bristled fasteners to suspend greeting cards.

U.S. Pat. No. 3,857,748 to C. S. Thomann on Dec. 31, 1974 describes a Christmas Tree Assembly having an assembly to be mounted on a door that has a triangular backing plate. A tubular trunk is mounted to the plate. The trunk has holes drilled therein and artificial branches are placed therein. The plate is mounted to the door by an L-shaped hanger and a turnbuckle to draw the plate tight.

U.S. Pat. No. 4,109,036 to G. R. Lloyd, et al., on Aug. 22 1978 for an Artificial Christmas Tree shows a tree having an upright trunk with holes therein to support a plurality of branches. The tree may be placed into a corner or against a wall. The base of the tree is fastened to a wall by a threaded fastener.

The present invention applies itself to providing a stable platform for decorations and solves the limited space problems.

SUMMARY OF THE INVENTION

Many people like to place Christmas trees in their dwellings or offices. But often finding a place to erect the tree is difficult due to space considerations. The present invention was created just for this purpose. Instead of a full, symmetrical tree having branches all around, the present tree allows the user to place branches only on that portion of the trunk that allows the tree to fit in a specific location. It is also very handy for commercial display promotions. The trunk is sectioned so that the tree can be packaged or stored conveniently. A vertical support feature keeps the tree from tipping over when the weight of the ornaments, cards and other decorations are placed on the tree. There are spring loaded clips on the branches to retain the ornaments, cards and other decorations in place.

A first embodiment of an artificial Christmas tree has a trunk having a branch retaining rod and a plurality of branch retaining ports in the branch retaining rod. A branch retaining rod vertical support member is attached to the branch retaining rod. There are a plurality of flexible branches. Each flexible branch has a flexible member. There are a plurality of artificial needles retained in the flexible member. Each flexible member has an insertion end for insertion into the branch retaining ports. An ornament retaining member is attached to the flexible branches. Each ornament retaining member has a hinged retaining clip and a spring. The spring is attached to and biases the hinged retaining clip from an open position to a closed position.

A second embodiment of an artificial Christmas tree has a trunk. The trunk has a branch retaining rod and a plurality of branch retaining ports in the branch retaining rod. There is a branch retaining rod vertical support member attached to the branch retaining rod. There are a plurality of flexible branches. Each branch has a flexible member and a plurality of artificial needles retained in the flexible member. The flexible member has an insertion end for insertion of the flexible member into a branch retaining port. An ornament retaining member is releasably attached to the flexible branches. Each ornament retaining member has a hinged retaining clip and a spring. The spring is attached to and biases the hinged retaining clip from an open position to a closed position.

It is an object of this invention to provide an artificial Christmas tree that allows the user to place the tree in an area where space is a premium and has to be conserved.

It is another object of this invention to provide an artificial Christmas tree that will fit flat against a wall or fit into a corner.

DESCRIPTION OF THE PREFERRED EMBODIMENTS

Figure 1:
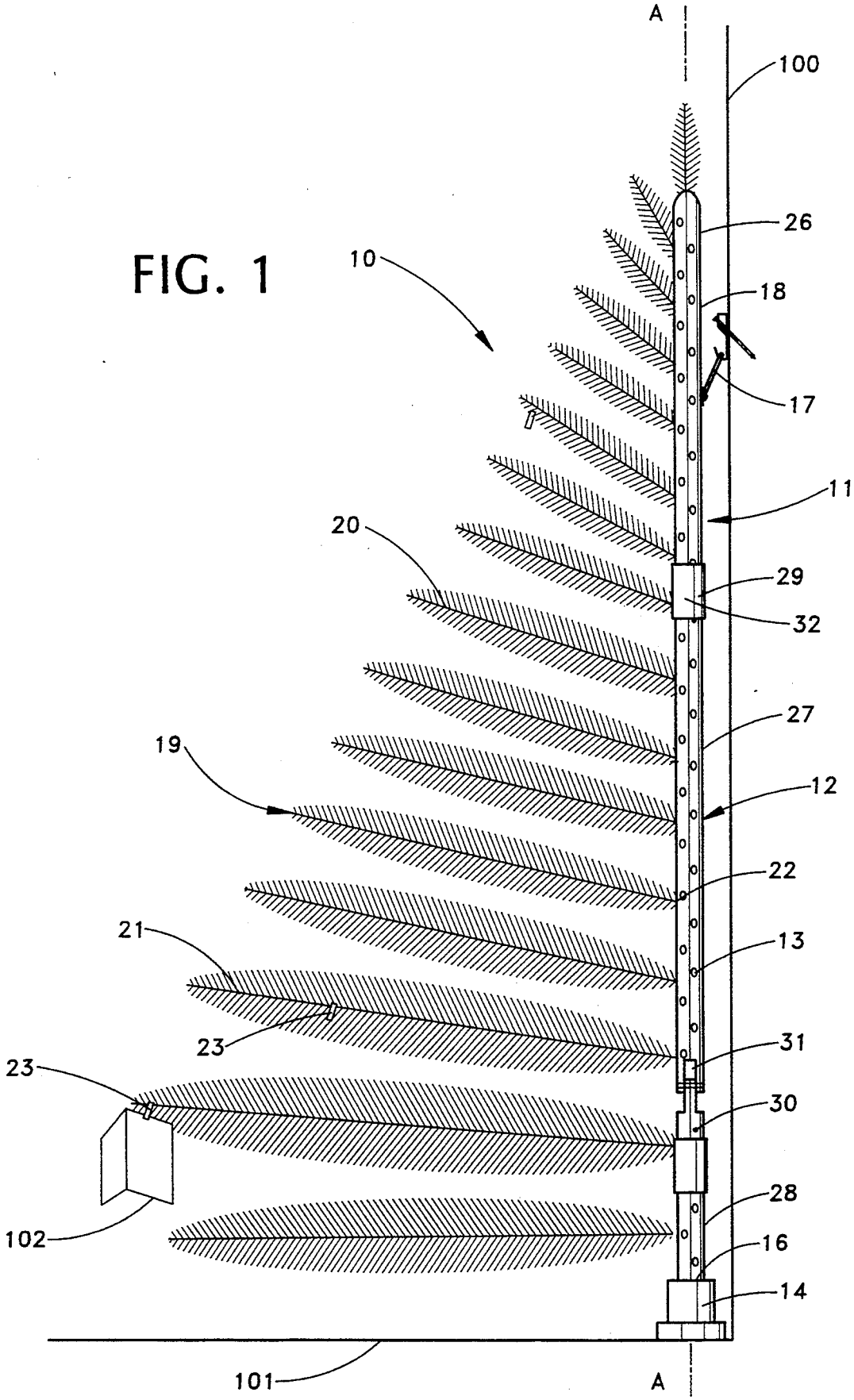
FIG. 1 is a left side elevational view of the Artificial Christmas Tree with several branches removed from the trunk to show the mounting holes, the base and the top suspension member.
Figure 3:
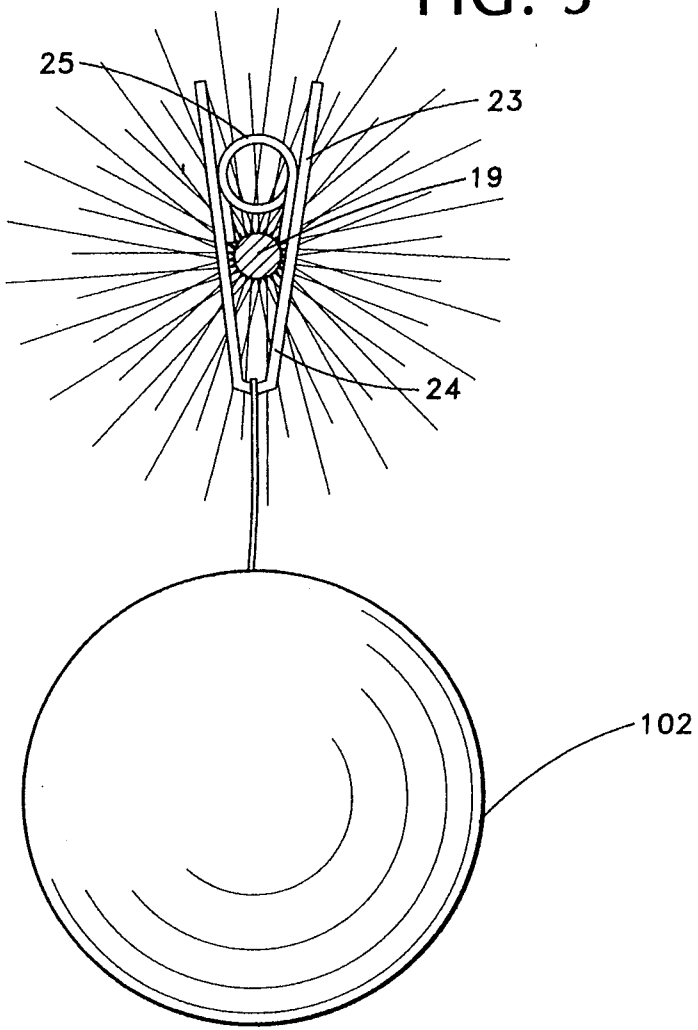
FIG. 3 is an enlarged, partial view of the card and ornament retaining member shown holding an ornament in place on a cross-section of a flexible branch.
Figure 2:
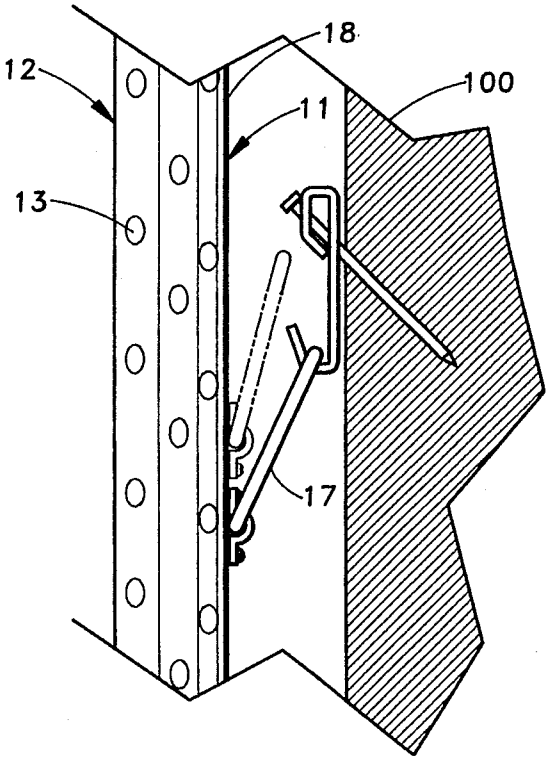
FIG. 2 is an enlarged, partial view of a section of the trunk showing the top suspension member attached to a portion of a vertical structure shown in partial cross-section.
Figure 4:
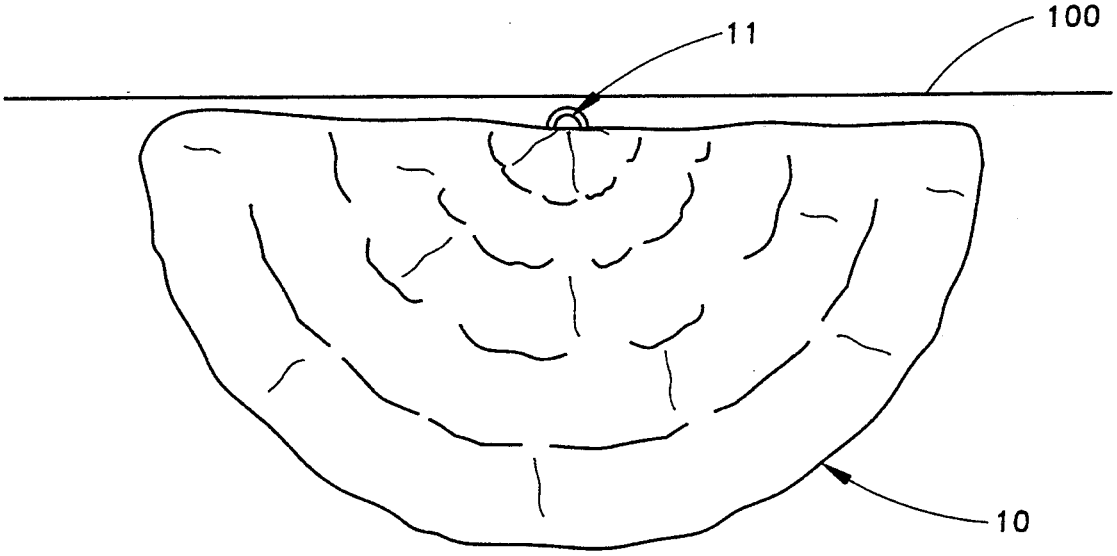
FIG. 4 is a top plan view of the artificial Christmas tree shown placed against a wall.
Figure 5:
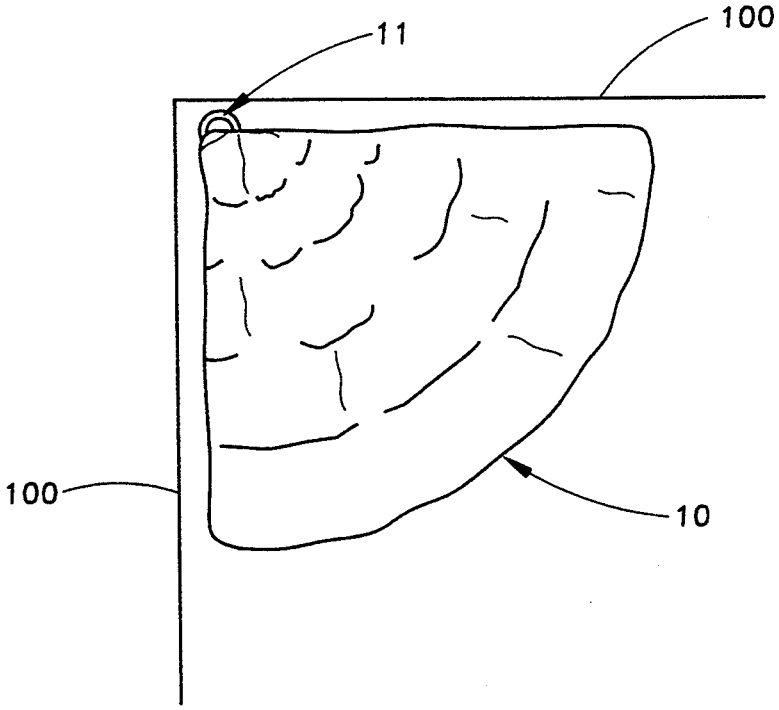
FIG. 5 is a top plan view of the artificial Christmas tree shown placed in a corner.
Figure 7:
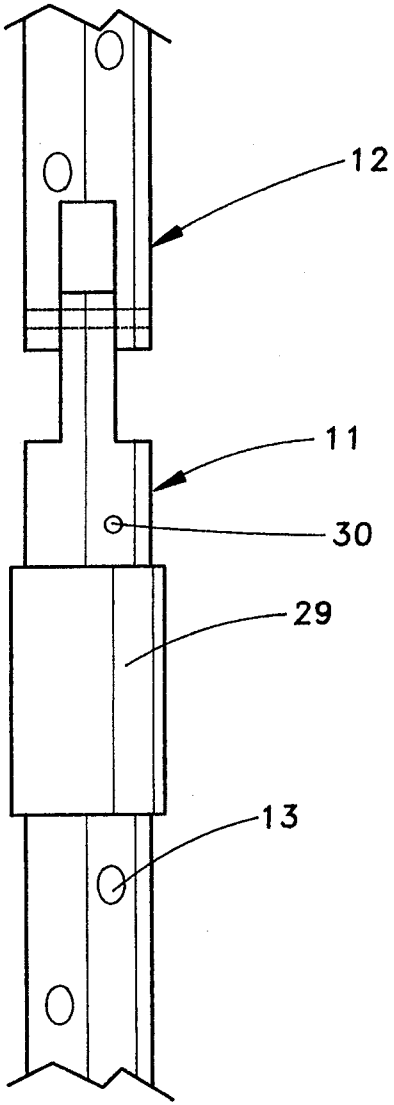
FIG. 7 is a partial front elevational view showing the folding interconnection of two of the sections of another embodiment of the trunk.
Figure 6:
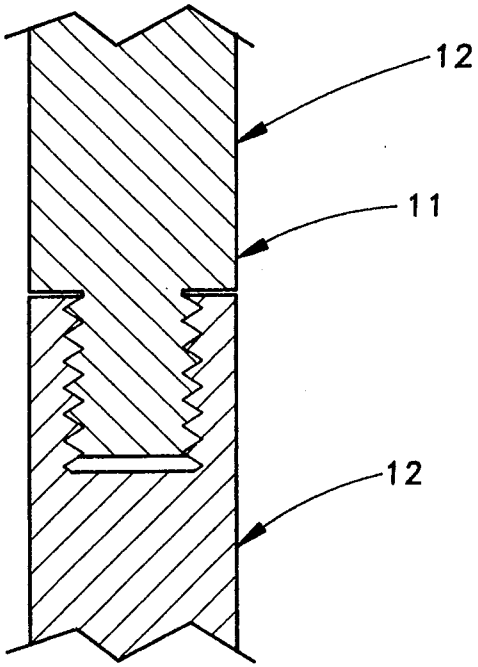
FIG. 6 is a partial front elevational view showing the threaded interconnection of two of the sections of one embodiment of the trunk.

Referring to FIGS. 1 through 7, an artificial Christmas tree 10 is shown and described that has a trunk 11. The trunk 11 has a branch retaining rod 12 (which could be a piece of tubular metal or a wood rod or a plastic molded rod) and a plurality of branch retaining ports 13 (either drilled or molded into rod 12) in the branch retaining rod 12. There is a branch retaining rod horizontal support member 14 (see FIG. 1) releasably attached to one end 16 (by either press fit or threadingly fastened) of the branch retaining rod 12. The horizontal support member 14 would normally rest on a floor 101 but could rest on any horizontal surface such as a table top. A branch retaining rod vertical support member 17 is attached (preferably by threaded fastener) to another end 18 of the branch retaining rod 12 (shown in FIG. 2). The vertical support member could be attached to a wall as shown in FIG. 2 or an extension member such as twine could be used to extend the reach of the vertical support member 17 if the trunk had to be placed further from the wall 100. There are a plurality of flexible branches 19. Each flexible branch 19 has a flexible member 20 and a plurality of artificial needles 21 (usually plastic) retained in the flexible member 20. The flexible member is usually twisted wire but may be a flexible plastic rod. The flexible member 20 has an insertion end 22 for insertion into a branch retaining port 13. There is an ornament retaining member 23 releasably attached to the flexible branches 19. The ornament retaining member 23 (may be made of plastic or metal) has a hinged retaining clip 24 and a spring 25 (see FIG. 3) to hold an ornament or card 102. The spring 25 is attached to and biases the hinged retaining clip 24 from an open position to an closed position. The branch retaining rod 12 also has at least two interconnectable sections 26, 27 and 28 (see FIG. 6) releasably and threadingly connected together (see FIG. 6).

Alternatively, the sections could also be hingedly connected together (see FIGS. 1 & 7) and fold into three interconnected sections 26, 27, and 28. When the rod are erected there could be a sliding sleeve 29 that moves along the longitudinal axis A—A of the sections of the rods to keep the sections aligned. A raised nodule 30 could interface with the inside surface (not shown) of the sliding sleeve 29 and could keep the sliding sleeve from moving accidentally once the sliding sleeve was moved from the folding position (indicated by number 31) to the locked position (indicated by number 32) of FIG. 1.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An artificial Christmas tree comprising:

(a) a trunk comprising:
- a branch retaining rod;
- the branch retaining rod comprising:
  - at least one hinge;
  - at least two sections hingedly connected together with the at least one hinge;
  - a hinge support lock sleeve to releasingly lock the hinges; and
  - a hinge support lock sleeve lock nodule;
- a plurality of branch retaining ports in the branch retaining rod;

(b) a branch retaining rod vertical support member attached to the branch retaining rod;

(c) a plurality of flexible branches comprising:
- a flexible member;
- a plurality of artificial needles retained in the flexible member; and
- the flexible member having an insertion end for insertion into a branch retaining port; and (d) an ornament retaining member releasably attached to the flexible branches comprising:
- a hinged retaining clip;
- a spring; and
- the spring attached to and biasing the hinged retaining clip from an open position to a closed position.

2. An artificial Christmas tree comprising:

(a) a trunk comprising:
- a branch retaining rod;
- the branch retaining rod comprising:
  - at least one hinge;
  - at least two sections hingedly connected together with the at least one hinge;
  - a hinge support lock sleeve to releasingly lock the hinges; and
  - a hinge support lock sleeve lock nodule;
- a plurality of branch retaining ports in the branch retaining rod;

(b) a branch retaining rod horizontal support member releasably attached to one end of the branch retaining rod;

(c) a branch retaining rod vertical support member attached to another end of the branch retaining rod;

(d) a plurality of flexible branches comprising:
- a flexible member;
- a plurality of artificial needles retained in the flexible member; and
- the flexible member having an insertion end for insertion into a branch retaining port; and (e) an ornament retaining member releasably attached to the flexible branches comprising:
- a hinged retaining clip;
- a spring; and
- the spring attached to and biasing the hinged retaining clip from an open position to a closed position.

3. An artificial Christmas tree as described in claim 2 wherein the branch retaining rod further comprises at least two interconnectable sections releasably and threadingly connected together.

* * * * *